United States Patent [19]

Weibe

[11] 4,164,726

[45] Aug. 14, 1979

[54] ENCAPSULATED PLUG-IN ELECTRICALLY CONDUCTING COMPONENT

[76] Inventor: Gerald L. Weibe, 18 W. 077 Williamsburg Lane, Villa Park, Ill. 60181

[21] Appl. No.: 922,151

[22] Filed: Jul. 7, 1978

Related U.S. Application Data

[63] Continuation-in-part of Ser. No. 820,627, Aug. 1, 1977, abandoned.

[51] Int. Cl.[2] ..... H01H 85/60

[52] U.S. Cl. ..... 337/215; 337/251; 337/252

[58] Field of Search ..... 339/19, 147 R, 258 R, 339/258 P; 337/198, 214, 215, 236, 251–253, 260–262, 264; 29/619, 621, 623; 338/273–275, 329

[56] References Cited

U.S. PATENT DOCUMENTS

| | | | |
|---|---|---|---|
| 2,052,533 | 8/1936 | Pender | 338/275 |
| 3,493,915 | 2/1970 | Cox | 339/19 X |

FOREIGN PATENT DOCUMENTS

| | | | |
|---|---|---|---|
| 1168526 | 9/1958 | France | 339/19 |
| 885170 | 12/1961 | United Kingdom | 337/198 |

*Primary Examiner*—George Harris
*Attorney, Agent, or Firm*—Dressler, Goldsmith, Clement, Gordon & Shore, Ltd.

[57] ABSTRACT

An encapsulated plug-in electrically conducting component is provided for mounting in an electrical connector. In one embodiment an elongate conducting element is transversely disposed across two spaced-apart generally parallel terminal posts and is secured at each of its ends to near the end of each post. In the preferred embodiment of the present invention, the component functions as a fuse wherein the elongate conducting element is a generally cylindrical fuse wire and wherein a solid unitary body of electrically insulating material encapsulates the fuse wire and the ends of each of the blades that are connected to the fuse wire. In another embodiment, a center portion of fuse wire is encapsulated with a thermoplastic to form a cylindrical body. The projecting end of the wire are bent over against the ends of the body. Cylindrical end caps compressively engage the body and are maintained in electrical contact with the fuse wire by solder material within the end caps.

The preferred embodiment of the fuse of the present invention is preferably formed by providing generally rectangular terminal posts in spaced-apart parallel relationship, aligning a fuse wire substantially perpendicular to said posts, soldering or clamping the fuse wire on each end to the posts, and encapsulating the assembly with a transparent thermoplastic material except for the ends of the posts opposite the fuse wire which are left projecting from the thermoplastic material for being received in connectors.

25 Claims, 29 Drawing Figures

19.
20.
21.
22.
23.
329
323
322
320
326
356
352
350
358
324
328
334
335
370
362
372
364
366
360
368

ENCAPSULATED PLUG-IN ELECTRICALLY CONDUCTING COMPONENT

CROSS REFERENCES TO RELATED APPLICATIONS

This application is a continuation-in-part of my copending application Ser. No. 820,627 entitled "Encapsulated Plug-In Electrically Conducting Component," filed Aug. 1, 1977 now abandoned. This application also discloses subject matter that is related to the subject matter disclosed in my copending applications Ser. No. 820,555 entitled "Three-Piece Solderless Plug-In Electrically Conducting Component," filed Aug. 1, 1977 and Ser. No. 820,724 entitled "Encapsulated Electrically Conducting Component With Reservoir End Caps," filed Aug. 1, 1977.

BACKGROUND OF THE INVENTION

The present invention relates in general to electrically conducting components and more particularly to the type of components which have projecting terminals extending from an encapsulating body and which may be engaged with female pressure clip connectors or plugged into female connectors which are commonly provided in elongate blocks of insulating material. The preferred embodiment of the present invention relates more specifically to a miniature size fuse for use in protecting electrical circuits, and especially for use in protecting electrically operated components in automotive vehicles.

The inventor of the present invention has developed an encapsulated type fuse which is disclosed in U.S. Pat. No. 3,914,863 and U.S. Pat. No. 3,832,664. The fuse disclosed in those patents does not have terminals projecting from the fuse. Further, the fuse disclosed in those patents has a cylindrical shape with cylindrical end caps in electrical contact with the fuse wire which is coiled or bent on each end of the fuse. The end caps are held against the bent ends of the fuse wire at each end of the fuse body and the end caps are mechanically secured to the fuse body.

The above-described fuse, which functions well for its intended purpose, cannot be used in plug-in type fuse receiving blocks and requires a number of manufacturing steps to bend the fuse wire ends and apply the end caps. It would be desirable to provide a relatively simple encapsulated fuse which does not require the additional steps of bending of the fuse wire ends and the securing of end caps thereto. Further, it would be desirable to provide a fuse with projecting terminals having a graspable structure which would be an aid in inserting or removing of the fuse. Yet such a structure should have a relatively smooth surface and preferably not be susceptible to accidental "snagging" which might dislodge the fuse.

Plug-in fuses have been developed today for use in automotive and other circuits and have a compact, substantially rectangular or square shape about ¾ inch on each side with a width of under ¼ inch. Such fuses have a fusible link surrounded by an insulating housing and have terminal-forming blade portions projecting from the housing. The blades and fusible link are made of metal and may be three separate pieces connected together or may be a single stamped piece of metal. For purposes of further discussion the term "fuse element" will be used to means an electrically conducting structure (commonly metal) the major portion of which is contained within the insulating housing or fuse body. The fuse element typically consists of (1) two conductor terminals (such as blades, posts, or other structures which commonly extend from the housing) and (2) one fusible link connecting the two terminals inside the housing.

A fuse having a fuse element consisting of a single piece stamping of a strip of fuse metal enclosed in a plastic housing is disclosed in the U.S. Pat. No. 3,909,767 to Williamson et al. A three-piece fuse element in which a fusible link is soldered to two blades within a plastic housing is disclosed in the U.S. Pat. No. 3,775,724 to Mamrick et al.

Fuses of the above-described types have met with significant commercial success and in general, have functioned satisfactorily for the intended purpose. However, in spite of their apparent simplicity, fuses of the above-described types have a number of drawbacks.

One disadvantage of the above-described types of fuses is that the insulating enclosures or housings surrounding the fuse element (blades and connecting fusible link) are not in intimate contact with the fusible link and the junctions with the terminal blades. The housing may or may not be open at the end from which the terminal-forming blade ends protrude. In either case, the housing is spaced away from the fusible link and/or upper portions of the blades to which the link is connected. The insulating housing thus defines a volume or space around the fusible link and necessarily contains an atmosphere of some kind. Generally, the housing interior communicates with the ambient atmosphere outside of the housing. Even those housings which totally enclose the upper portions of the terminal-forming blades and the fusible link are commonly not leak-tight and do allow air to pass into the housings to help dissipate the heat generated by the fuse element. Thus, it is possible for foreign matter, especially dust, airborne corrosive particles, and other such airborne contaminants, to enter the insulating housing and be deposited on the fusible element. To the extent that such airborne contaminants may react with, corrode, or otherwise have a deleterious effect upon the fusible link and/or upper portion of the terminal-forming blades, the admission of such contaminants is undesirable.

Even where an insulating housing could be made completely airtight, extraordinary care would have to be taken during manufacture to carefully control the atmosphere within the sealed insulating housing. If such care were not taken during manufacture, contaminants could be sealed within the housing during manufacture. Presumably, this problem would be somewhat alleviated by forming the insulating housing around the fusible link in a vacuum or in some inert atmosphere. Obviously, such a structure would be more complicated and expensive to manufacture than a structure not manufactured in a vacuum or in an inert atmosphere.

For those types of fuses in use today in which the housing is open to atmosphere or is not airtight, the internal volume within the housing around the fusible link is thus going to contain an atmosphere which may then vary in pressure as well as composition (e.g., water vapor content and contaminants) according to the variations in the ambient atmosphere. Thus, thermal conductivity and heat capacity of the atmosphere within the housing will vary to the extent of their dependence upon the above-listed parameters. Since the atmosphere within the housing functions, to some extent, to dissipate heat generated by the fuse element, variations in the atmosphere could cause slight variations in the rate of dissipation of heat generation from the fuse element. In some cases, depending upon the size of the fuse, the type of fusible link material employed, the current rating of the fuse and the normal design current passing through the fuse, the actual current level at which the fuse may "blow" could vary from the intended design rating.

With those types of fuses in use today in which the housing is open to the atmosphere or is not air-tight, there is the possibility that when the fuse blows, the arcing of the vaporizing fusible link can, because of the communication with the ambient atmosphere, ignite or explode combustible gases that may be present. This is especially important with respect to fuse applications in automotive vehicles, airplanes, ships and the like wherein during and/or after an accident or collison, one or more fuses may blow and where gasoline vapors or other fuel fumes may be present. Thus, it would be desirable to provide a totally encapsulated fuse wherein the arcing of the fusible link is entirely contained or submerged within a noncombustible material to prevent its communication with ambient atmosphere.

In a fuse having a fuse element consisting of a single piece stamping of fuse metal enclosed in a plastic housing, such as disclosed in the above-mentioned U.S. Pat. No. 3,909,767, the portion of the inner surface of the housing surrounding the fuse link is spaced away from the fuse link. In fuses of this type, the fuse element is typically stamped from zinc which has a relatively high melting point. If the fusible link portion of the fuse element is not spaced away from the interior surface of the plastic housing, the housing may melt when the fuse blows or in overload modes prior to blowing.

With those types of plug-in fuses having a fuse element stamped from a single piece of metal, there are other disadvantages. For example, the terminal-forming blade portions, as well as the fusible link, are necessarily formed from the same sheet of fusible metal. This presents certain problems. If it is desired to have a fusible link comprised of a very soft and low-melting alloy, the terminal-forming blades will be undesirably soft and ductile. Further, to the extent that a fusible link material is desired with a composition that is very carefully controlled and that is made from an expensive metal or metal alloy, the cost of the fuse is unnecessarily increased because the terminal-forming blade portions must also necessarily be composed of the more expensive material.

Typically, those types of plug-in fuses having fuse elements stamped from a single piece of metal use a zinc alloy for the fuse element. With such a one-piece element, both the fusible link and the terminal posts or terminal-forming blade portions of the fuse element are comprised of the zinc alloy. This has a serious drawback, however, because the plug-in fuse receiving housing commonly incorporates female pressure clip connectors which are made from brass. Owing to the galvanic cell created between the zinc alloy terminal-forming blades and the brass female pressure clip connectors, electrolytic corrosion can be a problem. Thus, it would be advantageous to provide a plug-in fuse wherein the terminal-forming blades are made of brass instead of zinc alloy. However, plug-in fuses having a fuse element stamped from a single piece of material are not easily made from brass owing to problems that brass presents in the stamping process. Fusible links typically have a relatively small cross section with a thickness measured in thousandths of an inch. It is very difficult to stamp the fusible link from brass to the proper dimensions within the necessary tolerances. Other metals, such as some zinc alloys, are much more suitable for the stamping process and can be stamped with a relatively small cross section within the necessary tolerances. Consequently, in order to take advantage of the strength and durability characteristics of brass, and in order to avoid electrolytic corrosion problems, it would be desirable to provide a plug-in fuse having brass blades but having a fusible link which can be formed from a different metal that is well-suited for the forming processes employed.

Further, it would be beneficial to provide a low melting point alloy fusible links, which has a lower melting point than zinc, or brass, to preclude localized melting and/or deformation of the plastic housing.

There is another disadvantage with plug-in fuses having a fuse element stamped from a single piece of metal. As each fuse element is stamped, the relatively complexly shaped die wears and the die cavity becomes larger. Therefore, as many fuse elements are stamped, the size of the fuse elements becomes larger and may eventually exceed the design tolerances. Though a die can be replaced when it has worn enough to produce stampings beyond the design tolerance, replacment of a complete die is expensive and is preferably avoided whenever possible. In contrast, in a fuse element having a separate, wire fusible link, the wire can be drawn through a multiple of relatively simple wire drawing dies of decreasing diameter wherein the very last (downstream) die is the smallest and effects the final wire diameter. Consequently, when the last die wears beyond the design tolerance, only this last die need be replaced. Replacement of just the last die is relatively inexpensive.

In a fuse that has a fusible link or wire surrounded by a housing or other material, it is important to provide a means whereby the heat generated in the fusible link can be uniformly conducted from all portions of the link so that the link will vaporize, as desired, in the "middle" of the fuse body and at the design current rating.

SUMMARY OF THE INVENTION

The present invention provides an extremely simplified electrically conducting component structure and method of forming the same. The component can be easily and efficiently manufactured. In the preferred embodiment, the component functions as a fuse and has a separate fusible link or wire mounted across two blades or terminal posts. The fusible wire is completely encapsulated in an insulating material and is thus protected from undesirable atmospheric contamination. In one embodiment of the invention, each terminal post has a unique cylindrical terminal structure on one end for being received in a mating female receiving clip. The encapsulating body is specifically shaped to promote uniform conduction of heat away from the fusible wire.

Specifically, in one embodiment of the invention used as a fuse, a pair of posts are stamped from a suitable conducting material and are each provided on one end with a flat fusible link support area. The other end of each post is formed into a terminal having the shape of a cylinder. The posts are spaced apart in generally parallel relationship and the fusible wire is aligned substantially perpendicular to each blade and is soldered to the link support area of each blade to provide an electrically conducting path from one of the blades through the fusible link to the other of the blades. The fuse wire and the link support area of each of the blades is encapsulated with a solid, one half disc-like unitary body of electrically insulated material such as a transparent thermoplastic, with the external surfaces of the fuse wire and blade spring clip portions in intimate contact with the encapsulating material. The cylindrical terminals are left projecting from the body and are filled with the thermoplastic to provide rigidity.

In another similar embodiment, the cylindrical terminal structure is formed from a plurality of hemi-cylindrical, wall members so that different size connectors can be easily accommodated by providing a lesser or greater number of such wall members.

The structure of the preferred embodiment of the present invention offers a number of advantages over the prior art described above in the "Background of the Invention." For example, the terminal-forming blades or posts can be made of any suitable conducting material and the fuse wire can be made of another material. This allows the posts to be formed of a material that will provide appropriate strength and durability which will withstand the abuse of insertions into female pressure spring clip assemblies. Owing to design of the posts, the same post design can be used for a number of differently rated fuses wherein fuse wires of different diameters are required.

The encapsulating material, being in intimate contact with the surfaces of the fuse wire, functions as a heat sink and can be formed around the fuse wire in a generally cylindrical shape to provide a substantially symmetrical temperature gradient and consequent uniform heat transmission from the fuse wire through the encapsulating material. The fact that the temperature gradient can be made substantially uniform and the fact that the fuse wire is not exposed to ambient air makes it possible to design a fuse which will "blow" at the specific current rating independent of atmospheric conditions and with negligible variation from fuse to fuse. Further, encapsulation of the fuse wire and fuse wire support of each post provides additional support for the fuse wire.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figure 1:
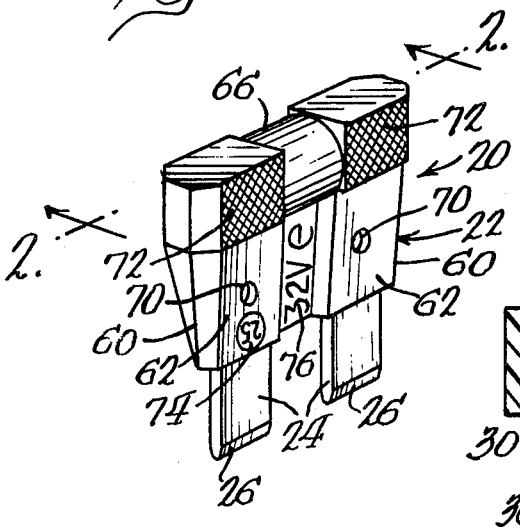
FIG. 1 is a perspective view of a first embodiment of a fuse formed in accordance with the teachings of the present invention.

While this invention is susceptible of embodiment in many different forms, there is shown in the drawings and will herein be described in detail exemplary embodiments of the invention, with the understanding that the present disclosure is to be considered as an exemplification of the principles of the invention and is not intended to limit the invention to the embodiments illustrated.

For ease of description, the component of the present invention will be described with the terminal-forming blades or posts oriented vertically and with the fusible link at the upper end of each blade. Terms such as upper, lower, horizontal, etc., will be used with reference to this position. It will be understood, however, that the product of this invention may be manufactured, stored, transported and sold in orientation other than the position described.

Referring now to the drawings a plug-in electrically conducting component of the present invention is illustrated in a fuse shown in its entirety at 20 in FIG. 1, and includes a body 22 and a pair of terminals or terminal-forming blades or blades 24. Typically, the height of the fuse, from the top of the body 22 to the bottom end of the blades 24 is about ¾ inch. The width of the body 22 is about ¾ inch and the thickness of the body 22 is about 3/16 inch. The blades are typically 0.025 inch in thickness and may be spring brass or aluminum.

The blades 24 are seen to project from the bottom of the body 22 and have tapered or pointed end portions 26 which readily slip into place between the confronting walls of a conventional female spring clip support in a mounting panel or fuse block (not shown). The three-piece solderless plug-in fuse element which is encapsulated in, and supported by, the body 22 will first be described in detail. Subsequently, the body 22 will be more fully described.

Figure 2:
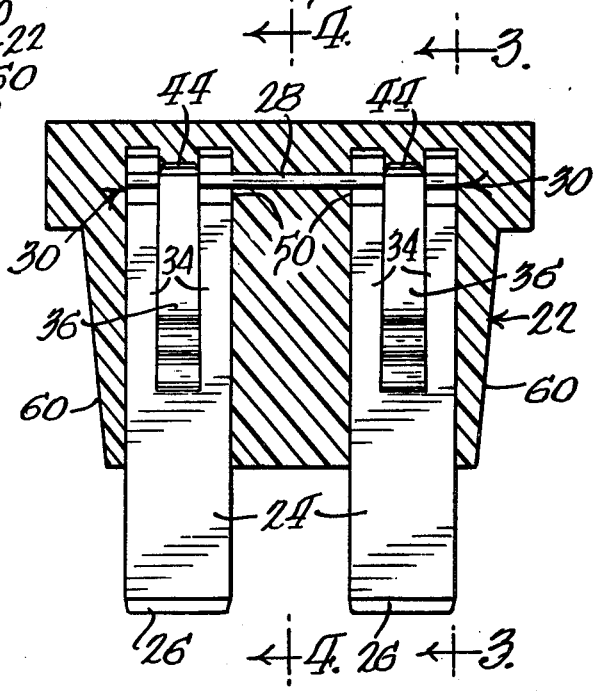
FIG. 2 is an enlarged cross-sectional view taken substantially along the plane 2—2 of FIG. 1.

With reference to FIG. 2, the three-piece fuse element is best illustrated as comprising the blades 24 and a fusible link, such as a substantially cylindrical fuse wire 28 connected between the pair of blades 24. Blades 24 are spaced apart in generally parallel relationship with the upper portions of the blades lying within the body 22. The fuse wire 28 is disposed substantially perpendicular to the blades 24 and a portion of the link 28 on each end is clamped by a novel spring slip structure 30 on the upper portion of each of the blades 24.

Figure 3:
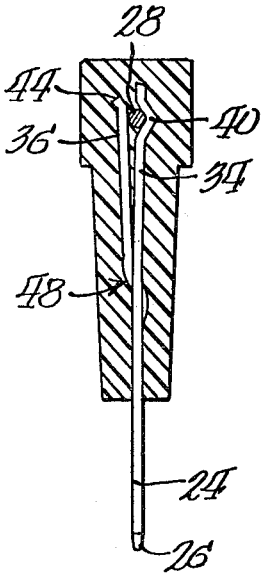
FIG. 3 is a cross-sectional view taken along the plane 3—3 of FIG. 2.
Figure 4:
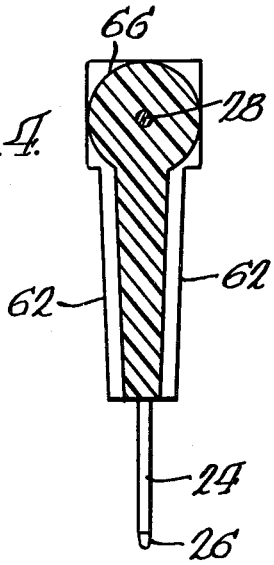
FIG. 4 is a cross-sectional view taken along the plane 4—4 of FIG. 2.
Figure 7:
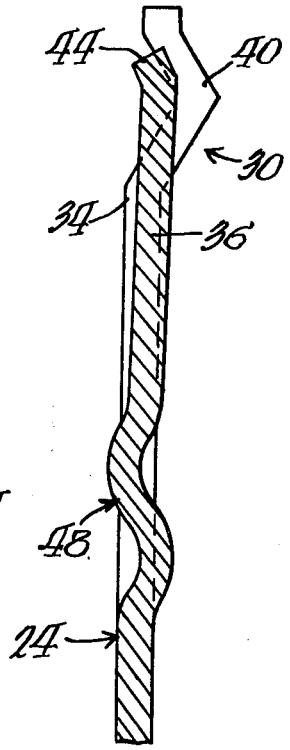
FIG. 7 is a cross-sectional view taken generally along the plane 7—7 of FIG. 6.
Figure 8:
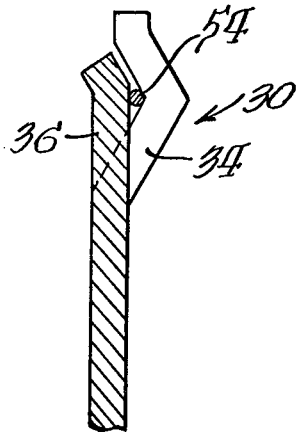
FIG. 8 is an enlarged fragmentary, cross-sectional view of the spring clip portion of the blade shown in FIG. 7 with a small fuse wire engaged therewith.
Figure 9:
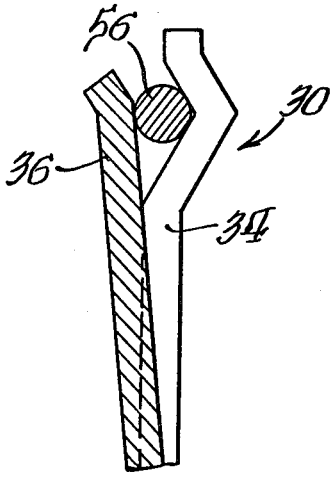
FIG. 9 is a fragmentary cross-sectional view similar to FIG. 8 showing the spring clip portion of the terminal blade of FIG. 7 with a large fuse wire engaged therewith.

With reference to FIGS. 3, 6, 7, 8, and 9, the spring clip structure of each blade 24 is seen to comprise a pair of spaced-apart rear bearing members 34 and a flexibly hinged front bearing tongue 36 between the rear bearing members 34. One end of the tongue 36 is free to bend outwardly as illustrated in FIGS. 3, 8, and 9 and the other end of the tongue 36 is integrally connected with the blade 24 to form a flexible hinge as at 38 in FIG. 6.

Each of the two rear bearing members 34 of the pair of rear bearing members 34 has a cradle 40 with a substantially V-shaped cross section for receiving a portion of the fuse wire 28 as is best illustrated in FIG. 3. To allow the fuse wire 28 to be easily inserted between the rear bearing members 34 and the flexibly hinged front bearing tongue 36, the tip 44 of the free end of the front bearing tongue 36 is angled outwardly away from the rear bearing members 34.

Figure 5:
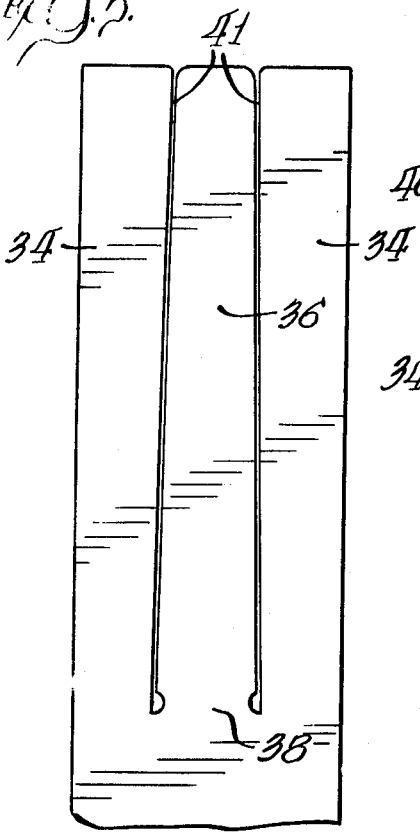
FIG. 5 is an enlarged fragmentary rear view of the spring clip portion of one terminal-forming blade after being blanked out but before being stamped into its final configuration.
Figure 6:
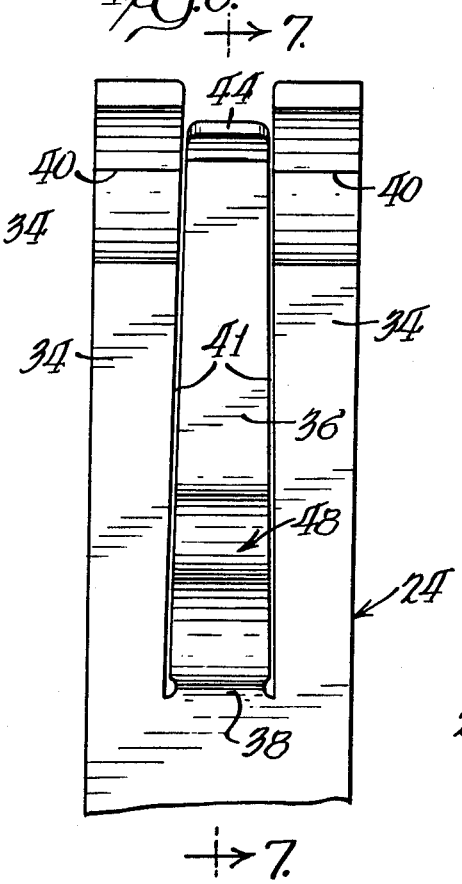
FIG. 6 is an enlarged fragmentary rear view like FIG. 5 but showing the spring clip portion of the terminal blade after having been stamped into its final configuration.

The spring clip structure, comprising the rear bearing members 34 and the front bearing tongue 36 of each blade 24, may be cut or blanked from a single sheet of material as illustrated in FIG. 5. In particular, the front bearing tongue 36 and the rear bearing members 34 are initially formed by providing cuts 41 on each blade 24. Following the blanking operation, the particular cradle configuration 40, the slanted tip 44 of the front bearing tongue 36 and the S-shaped portion 48 of the front bearing tongue 36 may be subsequently stamped in a separate operation. Alternatively, both the blanking and the forming of the blank into the final configuration may be performed in one step. If desired, the blade can be blanked as illustrated in FIG. 5 with the cuts 41 being slanted so that the width of the tongue decreases in width from a maximum at the flexible hinge 38 to a minimum at the free end or tip 44.

The flexing action of the front bearing tongue 36 may be controlled to some extent by the shape of the bottom portion of the tongue at its point of connection to the main part of the blade 24. Specifically, as illustrated in FIGS. 3 and 7, the front bearing tongue may have a generally S-shaped cross section on a portion of its length as at 48.

The front bearing tongue 36 is formed into an S-shaped cross section to reduce its overall length with respect to its extension from the flexible hinge 38. That is, the front bearing tongue 36 is drawn downwardly towards the flexible hinge 38 so that the tongue becomes located between the increased width region between the two rear bearing members 34, which increased width region is defined by the slanted or tapering cuts 41. This provides more freedom of movement of the tongue by reducing frictional interference between the tongue and rear bearing members.

The unique spring clip structure 30 described above offers a number of advantages. First, solder is not required to secure the fuse wire 28 to the blades 24. Second, the unique cradle structure 40 of each blade 24, in cooperation with the front bearing tongue 36, provides a self-aligning, clamping, engagement which is resistant to failure under vibration loading. In fact, to some extent, vibration of the assembly of the fuse wire blades would tend to promote proper centering of the fuse wire within the apex of the V-shaped cradles 40. That is, if for some reason during manufacture, the fuse wire 28 was displaced from the apex of the "V" and was improperly positioned on one or the other of the two legs of the "V" of the cradle 40, then any vibration would tend to cause the fuse wire 28 to slide along the leg of the "V" to the apex of the "V" wherein the wire 28 would be seated under influence of the opposing pressure of the front bearing tongue 36 in a self-aligning, clamping engagement.

The unique spring clip structure 30 of the present invention allows fuses to be constructed with precise ratings. As can be seen best in FIG. 2, the fuse wire 28 is in contact with each blade 24 at the inside edge 50 of each blade 24. It is the precise spacing between these two electrical contact points which determines the rating of the fuse for any given wire 28. The spacing between the two side edges 50 of a pair of blades 24 in a given fuse can be precisely controlled during fabrication so that the fuse rating can be precisely determined.

Various alloy compositions may be used for the fuse wire 28, depending upon the rating of the fuse. Typically, 95/5 tin lead wire is used. This is fairly soft and may bend slightly under the influence of the spring force of the front bearing tongue 36 pressing the wire 28 against the two V-shaped cradles 40 in each terminal blade 24 on either side of the tongue. By appropriate design, the spring force of the tongue is not high enough to cause the tongue 36 or the V-shaped cradle portions 40 of the terminal blade 24 to cut into the soft fuse wire 28. However, any slight "bending" of the fuse wire between the pair of cradles 40 of a blade 24 does effect an even more secure clamping engagement and is, for that reason, desirable.

For a given fuse wire composition, the diameter of the wire may be varied to obtain differing fuse ratings. As illustrated in FIGS. 8 and 9, the unique spring clip structure 30 of the present invention will, for a given size spring clip, accommodate fuse wires of varying diameter. In FIG. 8, a relatively small fuse wire 54 is shown clamped between the front bearing tongue 36 and the rear bearing member 34 and in FIG. 9, a relatively large diameter fuse wire 56 is shown clamped between the front bearing tongue 36 and a rear bearing member 34. Thus, it is possible that a single blade may be used in a large number of differently rated fuses. This of course promotes a certain economy of manufacture.

The novel spring clip structure of the present invention can easily accommodate, and is typically designed to accommodate, fuse wires having a diameter on the order of between 0.010 inches and 0.040 inches. The spring clip structure will typically permit the front bearing member to bend outwardly away from its normal vertical position to alignment with the rear bearing members a distance of about 0.052 inches to accommodate insertion of the 0.040 inch diameter fuse wire. Typically, the blades are made from spring brass which has been found to have the suitable spring characteristics.

The first embodiment described above has been illustrated with generally rectangular, male, terminal-forming blades. The present invention contemplates that the blades be received within an electrical component receiving block having within its pairs of spaced-apart, spring-biased, conducting strips forming female connectors for matingly engaging the blades of the electrical component. It is to be understood, however, that each of the blades of the electrically conducting component of the present invention may have a terminal-forming portion comprising a pair of spaced-apart, spring-biased, conducting elements or strips forming a female structure which could be connected with a male conducting structure mounted in a suitable receiving block.

Figure 10:
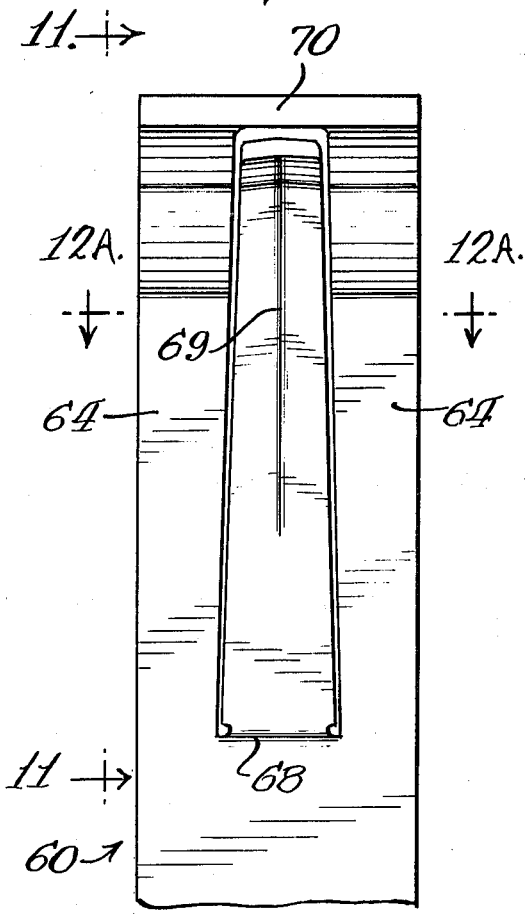
FIG. 10 is an enlarged fragmentary view like FIG. 6, but showing another embodiment of the spring clip portion of the terminal blade.
Figure 11:
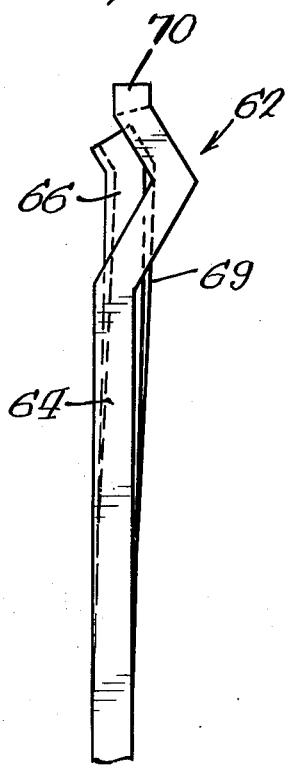
FIG. 11 is a side view taken generally along the plane 11—11 of FIG. 10.
Figure 12A:
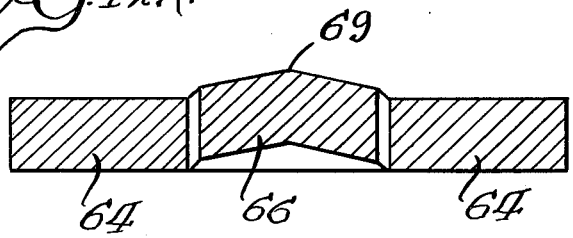
FIG. 12A is a cross-sectional view taken generally along plane 12A—12A of FIG. 10.

Another embodiment of a blade 60 incorporating a unique spring clip structure 62 of the present invention is illustrated in FIGS. 10, 11 and 12A. As in the first embodiment discussed above and illustrated in FIGS. 1 through 9, the second embodiment illustrated in FIGS. 10, 11 and 12A has a pair of rear bearing members 64 and a front bearing tongue 66 flexibly hinged between the rear bearing members 64. One end of the tongue 66 is free to bend outwardly as illustrated in FIG. 10 and the other end of the tongue is connected with the blade 60 by a flexible hinge 68.

The tongue 66 may be angled or bent, as at bend line 69, to provide more clearance between the rear bearing members 64 on either side of the tongue. The greater clearance effected by the novel bend configuration of tongue 66 is useful in accommodating any metal that may be displaced outwardly from the tongue during the stamping or blanking operation. The bend preferably extends about two-thirds of the length of the tongue. This bend configuration may also be incorporated in the first embodiment of the spring clip structure illustrated in FIGS. 1 through 9 and previously described.

In some instances, it may be preferable to provide a connecting, rigidifying member between the ends of the rear bearing members of each blade. To provide additional rigidity, and to better enable the rear bearing members to be held together at one time during insertion of a fuse wire between the rear bearing members 64 and the front bearing tongue 66, a connecting member or wall portion 70 is provided to interconnect the ends of the rear bearing members 64. The wall portion 70 may be a separate member secured on each end to the rear bearing member 64 or may be, as illustrated in FIGS. 10 and 11, integrally stamped from the blade 60 so as to be continuous with the rear bearing members 64. Such a rigidifying member 70 is desirable with a three-piece solderless component of the present invention where the component is embedded in a fuse body which is formed by high pressure injection molding of an insulating material. Without a rigidifying member 70, the rear bearing members 64 may, under the impingement action of the high pressure injection material, be bent or displaced from the desired orientation.

The three-piece electrically conducting component of the present invention is easily constructed by first forming the pair of blades and arranging the blades in spaced-apart, generally parallel relationship. The conducting element, such as a fuse wire, is aligned substantially perpendicular to the blades and seated within the clip structure of the blades by applying oppositely directed forces to the free ends of the front bearing tongue and the rear bearing members on each blade to spread them apart sufficiently so that the fuse wire can be inserted therein. Once the forces on the tongue and rear bearing members have been released, the fuse wire is automatically gripped.

In some instances, for example when using the electrically conducting three-piece component of the present invention as a fuse, an encapsulating body may be provided around the conducting element and a major portion of the blades. With respect to FIGS. 1 through 4, a fuse 20 has an encapsulating body 22 which is preferably a solid, unitary body of electrically insulating material, such as a thermoplastic, and which is in intimate contact with the external surfaces of the fuse wire 28 and the spring clip portions 30 of each blade 24. As is best illustrated in FIGS. 2 and 3, the body 22 extends over more than half the length of each blade 24.

The encapsulating body provides a gripping or supporting function with respect to the unique clip structure of the present invention. If the insulating material is a molded thermoplastic, owing to shrinking during cooling after the molding process, the thermoplastic material effects a more intimate contact between the fuse wire 328 and the posts 324 to thus reduce electrical contact resistance.

The body 22 may have a specific configuration required to fit within a fuse block. For example, the unitary body 22 may have two pairs of lower walls, such as end walls 60, slanting corner walls 61, and slanting side walls 62. The slanting walls slope inwardly towards the terminal portions of the blades 24 and may be wedged between walls (not shown) of a plug-in fuse block to hold the fuse therein.

Above the walls 60 and 62, the body 22 preferably has a cylindrical structure 66 as best illustrated in FIGS. 1 and 2. The cylindrical structure 66 is generally centrally located with respect to the length of the fuse so that the fuse wire 28 is substantially centered within the cylindrical structure 66. Centering of the fuse wire 28 within the cylindrical structure 66 effects a substantially symmetrical temperature gradient and consequent uniform heat transmission from the center segment of the fuse wire 28 through the cylindrical structure 66 to the surface of the fuse and then into the ambient atmosphere.

The body 22 is preferably made of a clear thermoplastic which can be easily molded about the three-piece fuse wire and blade assembly and which, owing to its transparency, effects an optical magnification of the fuse wire 28 through the generally cylindrical structure 66.

A number of different thermoplastic materials may be used for the body 22. For fuses of relatively low amperage capacity, a rubber-filled thermoplastic such as SAN may be used. For fuses having higher amperage capacities, a polycarbonate thermoplastic, such as LEXAN, may be used. For fuses with still higher amperage ratings, a thermoplastic that is more resistant to high temperatures, such as the high-temperature type of nylon, may be use.

Though it is preferable that the cylindrical portion 66 be made of a transparent thermoplastic to allow visual examination of the condition of the fuse wire 28 therein, it may also be desirable to add a pigment, surface coating or frosting to the remaining exterior portions, or parts of the remaining exterior portions, of the body 22. Further, apertures such as at 70, may be provided in one or more of the side surfaces 62 to allow insertion of a conventional electrical test probe (not shown) for contacting the blades 24 of the fuse to test the continuity of the fuse while it is plugged into a fuse block.

As illustrated in FIG. 1, a roughened or knurled gripping surface 72 may be provided on the upper exterior portions of the body 22 to permit one to better grip the fuse during insertion into, or removal from, a fuse receiving block. Preferably, the knurled surfaces 72 are located on either side of the generally cylindrical magnification structure 66. Additionally, various indicia such as at 74 and 76 may be provided on various exterior portions of the body 22 to indicate the electrical ratings, manufacturer's insignia and the like.

Figure 12:
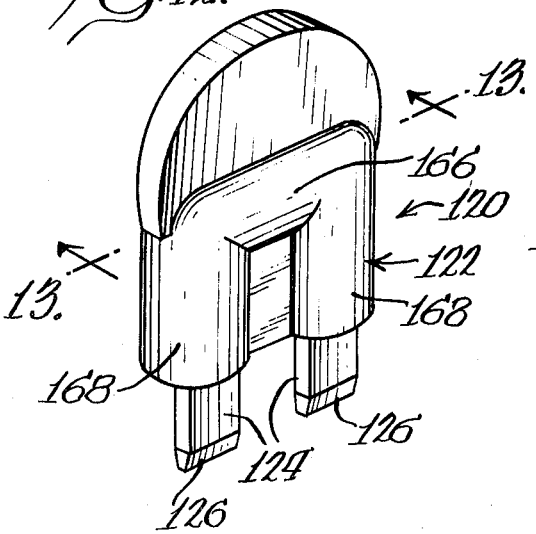
FIG. 12 is a perspective view of a third embodiment of a fuse formed in accordance with the teachings of the present invention.

A third embodiment of an encapsulated plug-in electrically conducting component of the present invention as illustrated in a fuse shown in its entirety at 120 in FIG. 12, and includes a body 122 and a pair of terminal posts, terminal-forming blades or blades 124. Typically, the height of the fuse, from the top of the body 122 to the bottom end of the blades 124 is about ¾ inch. The width of the body 122 is about ¾ inch and the thickness of the body 122 is about 3/16 inch. The blades are typically 0.025 inch in thickness.

The blades 124 are seen to project from the bottom of the body 122 and have tapered or pointed end portions 126 which readily slip into place between the confronting walls of a conventional female spring clip support in a mounting panel or fuse block (not shown). The encapsulating plug-in fuse element which is encapsulated in, and supported by, the body 122 will first be described in detail. Subsequently, the body 122 will be more fully described.

Figure 13:
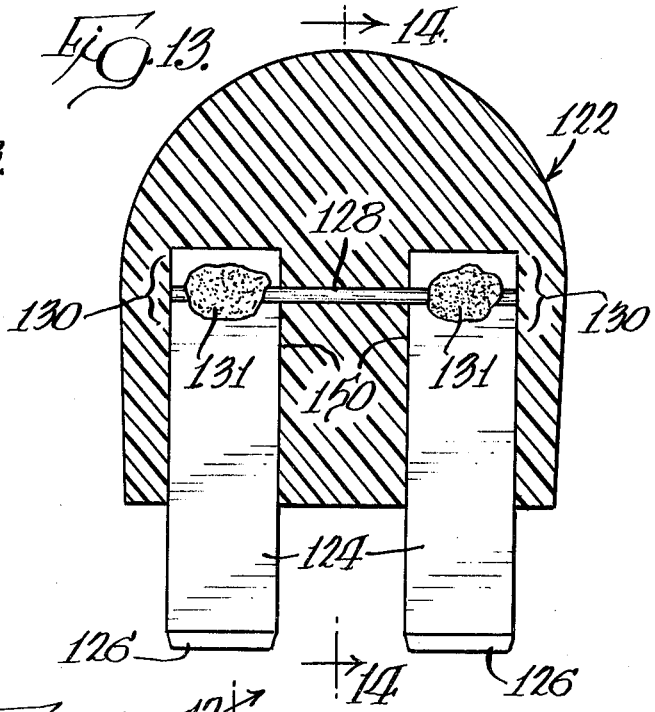
FIG. 13 is an enlarged cross-sectional view taken substantially along the plane 13—13 of FIG. 12.

With reference to FIG. 13, the fuse is best illustrated as comprising the blades 124 and fusible link, such as a substantially cylindrical fuse wire 128 connected between the pair of blades 124. Blades 124, being generally rectangular and coplanar, are spaced apart in substantially parallel relationship with the upper portions of the blades lying within the body 122. The fuse wire 128 is disposed substantially perpendicular to the blades 124 and a portion of the link 128 on each end is supported on a relatively large flat, fusible link support area 130 on the upper portion of each of the blades 124. The fuse wire 128 is typically secured to area 130 with solder 131.

The unique flat, fusible link support area 130 allows fuses to be constructed with precise ratings. To this end, it is important that the area 130 is wider than the deposited solder 131. As can be seen best in FIG. 13, the fuse wire 128 is in contact with each blade 124 at the inside edge 150 of each blade 124. It is the precise spacing between these two electrical contact points which determines the rating of the fuse for any given wire 128. The spacing between the two side edges 150 of a pair of blades 124 in a given fuse can be precisely controlled during fabrication so that the fuse rating can be precisely determined. This is in contrast to solder-type connections where the mass of deposited solder extends beyond the inside edge 150 of the blade and where the actual distance along the fuse wire between the two solder masses cannot be easily predetermined or controlled during fabrication.

Various alloy compositions may be used for the fuse wire 128, depending upon the rating of the fuse. Typically, 95/5 tin lead wire is used. For a given fuse wire composition, the diameter of the wire may be varied to obtain differing fuse ratings. The unique link support area 130 of the present invention will, for a given size blade or post 124, accommodate fuse wires of varying diameter. Thus, it is possible that a single blade or post may be used in a large number of differently rated fuses. This of course promotes a certain economy of manufacture.

The above-described third embodiment of the encapsulated electrically conducting component of the present invention is easily constructed by first forming the pair of blades and arranging the blades in spaced-apart, generally parallel relationship. The conducting element, such as a fuse wire, is aligned substantially perpendicular to the blades and seated on the link support area of the blades. The wire is then soldered to the blades. Following this, the wire and upper portions of the blades are encapsulated with a thermoplastic material.

Figure 14:
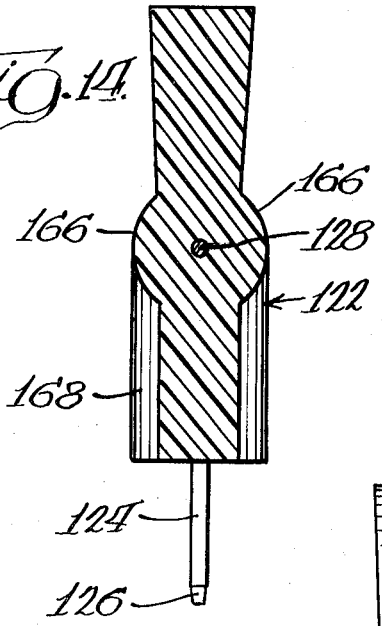
FIG. 14 is a cross-sectional view taken along the plane 14—14 of FIG. 13.

With respect to FIGS. 12 through 14, fuse 120 has an encapsulating body 122 which is preferably a solid, unitary body of electrically insulating material, such as a thermoplastic, and which is in intimate contact with the external surfaces of the fuse wire 128 and the link support area 130 of each blade 124. As is best illustrated in FIGS. 13 and 14, the body 122 extends over more than half the length of each blade 124.

The encapsulating body provides a gripping or supporting function with respect to the fuse wire. If the insulating material is a molded thermoplastic, owing to shrinking during cooling after the molding process, the thermoplastic material effects a more intimate contact between the fuse wire 128 and posts 124 to thus reduce electrical contact resistance.

As is best illustrated in FIG. 13, the body 122 has a generally one half disc-like shape that is slightly elongated at the diametral edge of the body. The body 122 preferably has a region of increased thickness 166 defined on the two major side surfaces of the body by protuberances in superposed alignment with the fuse wire 128. Each protuberance or region of increased thickness 166 has a general shape of a cylindrical sector presenting a generally convex, circular arc, exterior surface. The region of increased thickness 166 is generally centrally located with respect to the length of the fuse so that the fuse wire 128 is substantially centered within the increased thickness region. Centering of the fuse wire 128 within the increased thickness region effects a substantially symmetrical temperature gradient and consequent uniform heat transmission from the center segment of the fuse wire 128 through the increased thickness 166 to the surface of the fuse and then into the ambient atmosphere.

An upper segment of the disc-shaped body is seen to have generally smooth, flat and curved surfaces. The absence of corners, angles, or apertures eliminates the possibility that the fuse may be accidentally snagged and disengaged from a fuse receiving block.

To provide increased support and to provide a more uniform temperature gradient distribution around the terminal blades 124, regions of increased thickness 168 may be provided adjacent each blade 124. Preferably, the regions of increased thickness 168 are also defined on the two major side surfaces of the body by protuberances in superposed alignment with the blades 124, with each protuberance having the general shape of a cylindrical sector presenting a generally convex, circular arc, exterior surface.

The body 122 is preferably made of a clear thermoplastic which can be easily molded about the three-piece fuse wire and blade assembly and which, owing to its transparency, effects an optical magnification of the fuse wire 128 through the generally cylindrical structure 166.

As with the first embodiment previously described, a number of different thermoplastic materials may be used for the body 122. For fuses of relatively low amperage capacity, a rubber-filled thermoplastic such as SAN may be used. For fuses having higher amperage capacities, a polycarbonate thermoplastic, such as LEXAN, may be used. For fuses with still higher amperage ratings, a thermoplastic that is more resistant to high temperatures, such as the high-temperature type of nylon, may be used.

Though it is preferable that the cylindrical portion 166 may be made of a transparent thermoplastic to allow visual examination of the condition of the fuse wire 128 therein, it may also be desirable to add a pigment, surface coating or frosting to the remaining exterior portions, or parts of the remaining exterior portions, of the body 122. Further, apertures (not illustrated, but similar to apertures 70 described for the first embodiment illustrated in FIG. 1) may be provided in the body 122 to allow insertion of a conventional electrical test probe for contacting the blades 124 of the fuse to test the continuity of the fuse while it is plugged into a fuse block.

Figure 15:
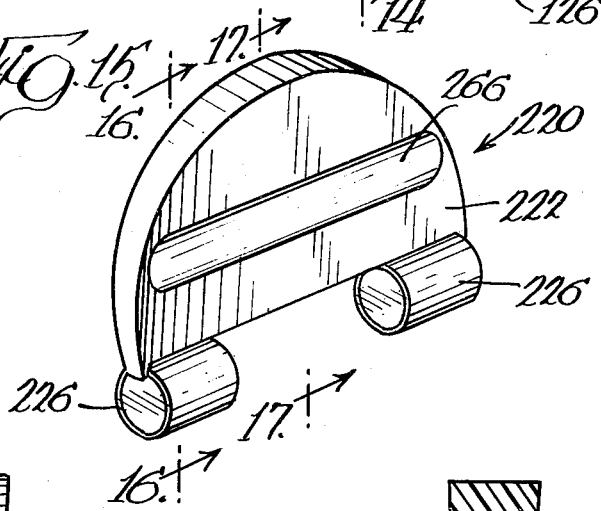
FIG. 15 is a perspective view of a fourth embodiment of the fuse formed in accordance with the teachings of the present invention.
Figure 16:
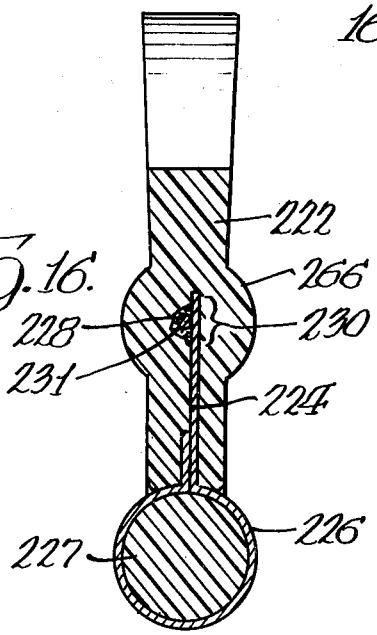
FIG. 16 is an enlarged cross-sectional view taken along the plane 16—16 of FIG. 15.
Figure 17:
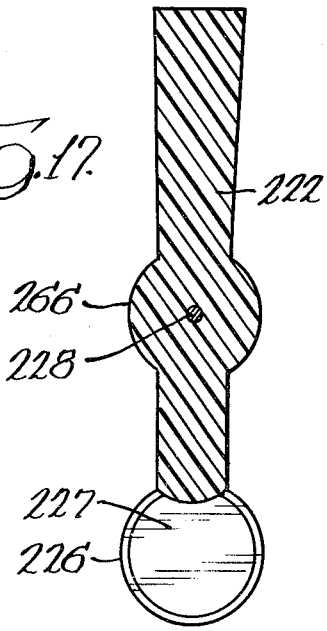
FIG. 17 is a cross-sectional view taken generally along the plane 17—17 of FIG. 15.

Another embodiment of the encapsulated plug-in electrically conducting component of the present invention is illustrated in FIGS. 15 through 17 and is designated generally therein by numeral 220. A generally one half disc-like body 222 encapsulates a pair of terminal posts 224 which project from the bottom of the body 222 and present a generally cylindrical terminal 226. The cylindrical terminals 226 readily slip into place between mating confronting walls of a conventional female clip in a mounting panel.

As illustrated in FIG. 16, a fusible link, such as a substantially cylindrical fuse wire 228 is connected between the pair of terminal posts 224 in much the same manner as the fuse wire 128 is connected between terminal posts 124 of the third embodiment previously described and illustrated in FIG. 13. The terminal posts 224 are spaced apart in generally parallel relationship with the upper portions of the terminal posts lying within the body 222. The fuse wire 228 is disposed substantially perpendicular to the terminal posts 224 and a portion of the wire 228 on each end is supported on a relatively large flat, fusible link support area 230 on the upper portion of each of the terminal posts 224. The fuse wire 228 is typically secured to the area 230 with solder 231.

With respect to FIG. 15, fuse 220 has an encapsulating body 222 which is preferably a solid, unitary body of electrically insulating material, such as a thermoplastic, and which is in intimate contact with the external surfaces of the fuse wire 228 and the link support area 230 of each terminal post 224. As is best illustrated in FIG. 16, the body 222 extends over more than half of the length of each terminal post 224.

The encapsulating body 222 provides a gripping or supporting function with respect to the fuse wire 228. If the insulating material is a molded thermoplastic, owing to shrinking during cooling after the molding process, the thermoplastic material provides an even better support for the fuse wire 228.

As is best illustrated in FIG. 16, each cylindrical terminal 226 is filled with the electrically insulating material 227 which is preferably the same material as used for the body 222. This adds rigidity to the cylindrical terminal structure and serves to prevent the cylindrical terminal 226 from being deformed upon insertion into the female receiving clip.

Preferably, a region of increased thickness 266 is provided adjacent the fuse wire 228 and is defined on the two major side surfaces of the body 222 by protuberances in superposed alignment with the fuse wire. Each protuberance or region of increased thickness 266 has the general shape of a cylindrical sector presenting a generally convex, circular arc exterior surface. This provides a substantially symmetrical temperature gradient and consequent uniform heat transmission from the fuse wire 228 through the body.

The body is preferably made of clear thermoplastic which can be easily molded about the three-piece fuse wire and terminal post assembly and which, owing to its transparency, effects an optical magnification of the fuse wire 228 through the generally cylindrical structure 266.

Figures 18, 19, 20, 21, 22, 23, 24:
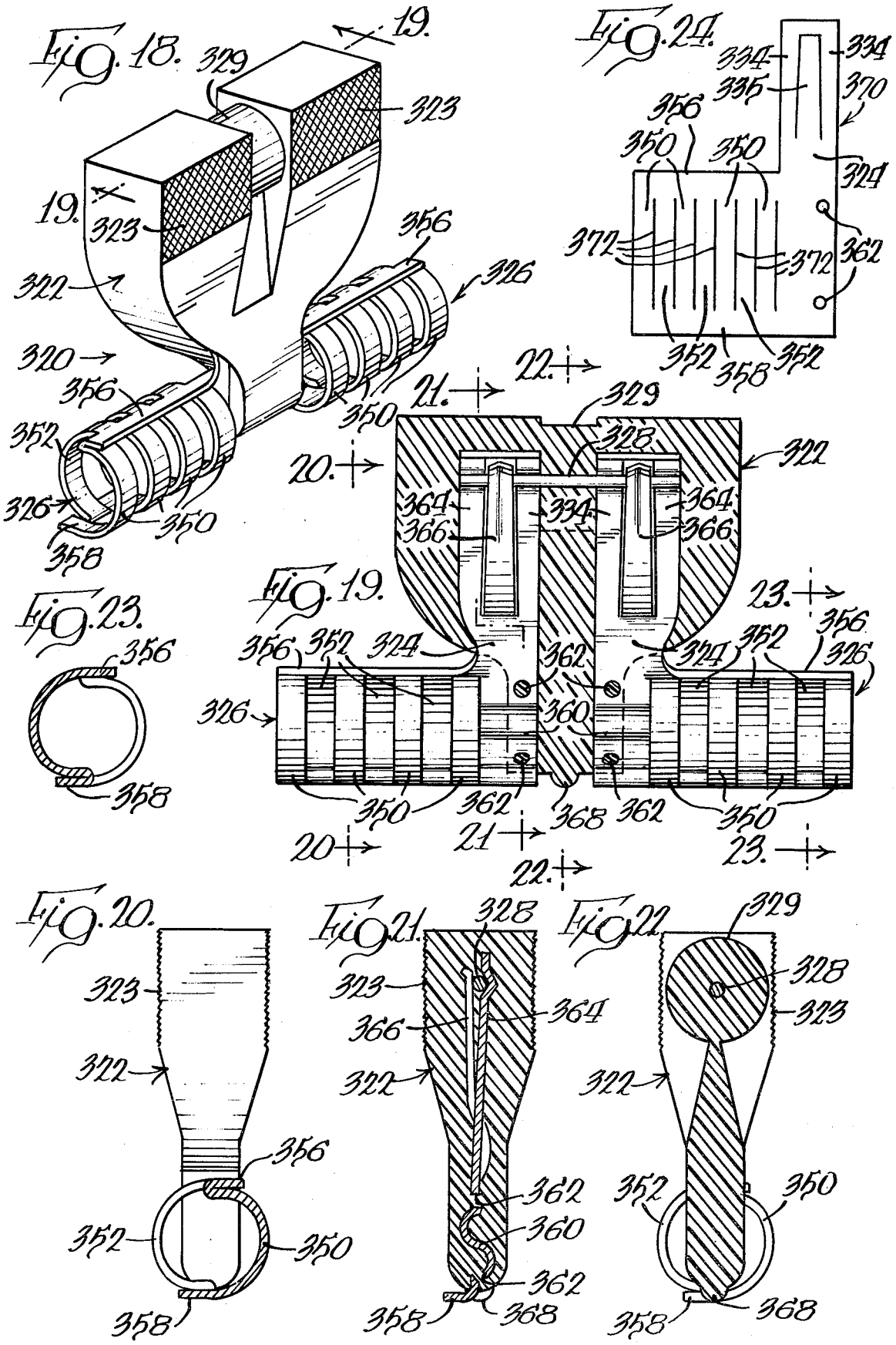
FIG. 18 is a perspective view of the fifth embodiment of the fuse formed in accordance with the present invention.
FIG. 19 is an enlarged cross-sectional view taken substantially along the plane 19—19 of FIG. 18.
FIGS. 20 through 23 are cross-sectional views taken substantially along the planes 20 through 23, respectively, of FIG. 19.
FIG. 24 is a view of a stamped plate prior to being formed into one of the terminal members of the fuse illustrated in FIG. 18.

A fifth embodiment of the encapsulated plug-in electrically conducting component of the present invention is illustrated in FIGS. 18 through 24 and is designated generally in the perspective view of FIG. 18 by numeral 320.

With reference particularly to FIGS. 18 and 19, it can be seen that a grippable body 322 encapsulates a pair of terminal posts 324 which project from the bottom and from the lower sides of the body 322 and which are connected to generally cylindrical terminal means 326. The cylindrical terminal means 326 readily slip into place between mating confronting walls of a conventional female clip in a fuse mounting panel.

As illustrated in FIG. 19, a fusible link 328, such as a substantially cylindrical fuse wire, is connected between the pair of terminal posts 324 in the same manner as the fuse wire 28 is connected between terminal posts 24 of the first embodiment previously described and illustrated in FIG. 2.

Each terminal post 324 includes a spring clip structure comprising a pair of spaced apart rear bearing members 364 and a flexibly hinged front bearing tongue 366 between the rear bearing members 364. The upper portion of the terminal posts 324, including the spring clip structure, is identical with that previously described and illustrated in FIGS. 10, 11, and 12A.

The terminal posts 324 are spaced apart in generally parallel relationship with the upper portions of the terminal posts lying within the body 322. The fuse wire 328 is disposed substantially perpendicular to the terminal posts 324 and a portion of the wire 328 on each end is clamped in the spring clip structure of each terminal post 324.

The encapsulating body 322 of the fuse 320 is preferably a solid, unitary body of electrically insulating material, such as thermoplastic, and is in intimate contact with the external surfaces of both the fuse wire 328 and the upper, spring-clamp portions of each terminal post 324.

The encapsulating body 322 provides a supporting function with respect to the fuse wire 328. If the insulating material is a molded thermoplastic, owing to shrinking during cooling after the molding process, the thermoplastic material effects a more intimate contact between the fuse wire 328 and posts 324 to thus reduce electrical contact resistance.

A portion of the exterior surface of the body 322 may be roughened or knurled, as at 323, to provide a non-slip gripping surface when the fuse body is held between the thumb and forefinger.

The body 322, in the region surrounding the central potion of the fuse wire 328, preferably has the shape of a cylindrical sector presenting a generally convex, circular arc exterior surface. This provides a substantially symmetrical temperature gradient during the transmission of heat from the fuse wire 328 through the body 322.

The body 322 is preferably made of a clear thermoplastic which can be easily molded about the three-piece fuse wire and terminal post assembly and which, owing to its transparency, effects an optical magnification of the fuse wire 328 through the generally cylindrical structure 329.

The cylindrical terminal means 326 is a novel structure for this type of fuse and provides a number of advantages. As can be best seen in FIGS. 18 and 19, each cylindrical terminal means 326 is integrally connected with a terminal post 324 and extends outwardly from the terminal post 324 about an axis generally parallel with the fusible link 328. Each terminal means 326 comprises four wall members 350, each wall member 350 having a generally hemicylindrical surface, and three other wall members 352, each other wall member 352 having oppositely oriented, generally hemicylindrical surfaces. Each hemicylindrical wall member extends substantially 180 degrees so that any two pairs of adjacent, oppositely oriented wall members form a cylinder. All seven wall members 350 and 352 form a longer cylinder.

The hemicylindrical wall members 350 and 352 are secured at a first end by a first connecting strip 356 at a second end by a second connecting strip 358 as best illustrated in FIGS. 18, 20, and 23.

In the portion of each terminal post 324 adjacent the cylindrical terminal means 326 the terminal post 324 is formed into an S-shaped configuration 360 as best illustrated in FIGS. 19 and 21. Also, in this same region, apertures 362 are provided in the terminal post 324 to permit the encapsulated material such as a thermoplastic, to flow into the apertures and solidify to provide increased resistance to movement of the terminal post 324 within the body 322.

Preferably, the body 322 is formed with a protuberance 368 at the bottom between the two terminal posts 324. The protuberance 368 is designed to act as an abutment when the fuse 320 is pushed downwardly against a solid surface or against some portion of a fuse holding panel. This prevents the terminal means 326 from being bent upwardly if excessive force is applied in such situations.

The terminal posts 324 and terminal means 326 are preferably formed together from generally L-shaped metal plates 370 as best illustrated in FIG. 24. Preferably, slits 372 are first formed in a larger metal strip from which the L-shaped plates 370 are to be stamped. Next the L-shaped metal plates 370 are stamped out and then the spring clip structure (bearing members 364 and tongue 366) are formed therein along with apertures 362. The L-shaped plates 370 are stamped so that the slits 372 are generally parallel to the terminal post 324 and define the wall members, alternately numbered 350 and 352, therebetween. Unslit regions remain at each end of the plurality of slits 372, which regions comprise the first and second connecting strips 356 and 358 respectively.

Next, the cylindrical shape of the terminal means 326 is created by forming the terminal portion of each stamped L-shaped metal plate 370 into a generally cylindrical shape, as by forcing the wall members 356 and 358 outwardly with a punch into suitable die recesses to cause the wall members 350 and 352 to bow outwardly into the hemicylindrical configurations. As this is being done, the region of the terminal post 324 adjacent the wall members 350 and 352 is formed into an S-shaped configuration 360 (see FIG. 21) to accommodate the decrease in the width dimension of the terminal portion.

Preferably, the connecting strips 356 and 358 are bent over at right angles with respect to the plane of the terminal posts 324 during one of the forming or stamping steps to eliminate the possibility of upstanding sharp edges and further to insure that the cylindrical terminal means 326 can be pushed downwardly into a receiving member as far as possible.

Preferably, a plurality of pairs of the two L-shaped metal plates 370 are stamped and formed as described above from a long strip of metal or coil stock, with the plates of each pair, still attached to a carrier strip of the metal, positioned in oppositely oriented, spaced-apart relation with the terminal post portions 324 generally parallel. A fusible link is then placed perpendicular to, and across, the posts 324 and is connected to the posts 324 with the spring-clamp structure (the bearing member 364 and the tongue 366). The fusible link 328 and at least a portion of each post 324 (at the connection to the fusible link) is then encapsulated within a solid unitary body of electrically insulating material so that the external surfaces of the link and of the portion of each post connected to the link are in intimate contact with the material.

The novel terminal means structure formed from the slit, L-shaped plate permits the efficient fabrication of different size fuses and permits fuse holders of various lengths to be easily accommodated with one stamping tool and one molding tool. The length of the terminal means 326 can be varied during the initial stamping of the strip of coil stock. Only one slit-forming tool, having a maximum number of slit forming punches, need be used. The number of opposed, adjacent hemicylindrical wall members 350 and 352 that are formed with such a tool depends only upon the length of the stamped terminal portions. Even after the fuse has been fabricated, it is possible to break off one or more of the hemicylindrical wall members 350 and 352 to provide a terminal means 326 having a suitable, shorter length.

The use of a totally encapsulated body of insulating material surrounding the fuse element in accordance with the present invention serves to contain the electrical arc generated when the fuse blows. Since the arc is not then in communication with the ambient atmosphere, it is impossible for the fuse, upon blowing, to ignite any combustible vapors which may be in the ambient atmosphere. Thus, a fuse structure in accordance with the present invention provides a fuse which is essentially non-explosive and therefore desirable for use in automobiles, airplanes, ships and the like, as well as in stationary industrial applications where explosive vapors are a problem.

Figure 25:
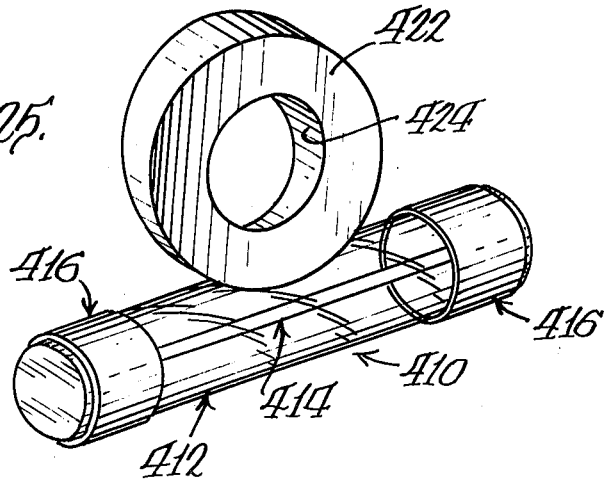
FIG. 25 is a perspective view of a sixth embodiment of the fuse formed in accordance with the teachings of the present invention.

Referring now to FIGS. 25 through 28, the sixth embodiment electrically conducting component of the present invention is shown, in a preferred embodiment as a fuse, in its entirety at 410 in FIG. 25, and includes a body 412, a fusible link 414, and end caps 416.

Figure 26:
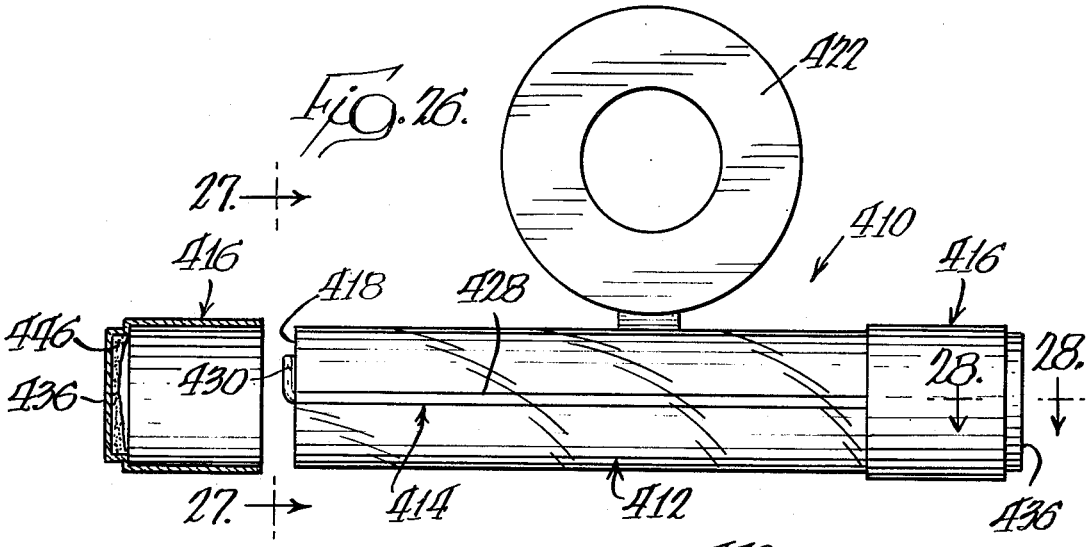
FIG. 26 is a side elevational view, partially in cross section and partially exploded.

In the illustrated embodiment, body 412 is a solid, unitary, generally cylindrically-shaped member having flat, parallel, opposite end surfaces 418 as best illustrated in FIG. 26 for the left-hand end portion of the fuse. The body 412 is preferably formed by a molding process with the fusible link 414 having been previously placed in the cavity of the mold, so as to be positioned centrally within the body 412. The body 412 is preferably formed from a clear plastic material, such as the thermoplastic polycarbonate resin sold by General Electric Company under the trademark LEXAN. Other clear, tough, heat-resistant, dimensionally stable, non-conductive plastic materials may also be used, such as high impact polystyrene, cellulose propionate, cellulose acetate-butyrate, etc. While thermoplastic materials are preferred, the present invention contemplates that certain thermosetting materials may be used. The particular plastic material that is utilized is selected so that its properties, in combination with the properties of the fusible link, give the resulting fuse the desired rating and performance characteristics.

While body 412 is generally cylindrically shaped, as previously described, a gripping handle 422 is preferably formed integrally with the body to facilitate insertion and removal of the fuse in a fuse holding clip structure, not shown. Handle 422 may be provided with an opening 424, so that the fuse may be readily carried (or displayed) on a key chain, or the like. The generally cylindrical configuration is preferred, although it is contemplated that the fuse body may be other than circular in cross section, e.g., oval, square, hexagonal, etc. In all fuse bodies, it is desired that at least the end portion thereof be circular in cross section, so as to readily accept conventional end caps, as will hereinafter appear. The fusible link 414 is in the form of an elongate wire, which in the illustrated embodiment is circular in cross section and centered relative to body 412, as previously mentioned. The external surface of the major portion 428 of the fusible link (FIG. 26), which is embedded in situ in body 412 by virtue of the molding operation, is in intimate surface-to-surface contact with the thermoplastic body 412.

The wire 414 is preferably, although not necessarily, a low-melting point alloy such as, for example, an alloy consisting essentially of from about 95 percent tin to about 5 percent lead. The present invention contemplates the use of fusible link wires 414 having diameters of between 0.010 and 0.050 inch, depending on the current rating of the fuse. While low-melting point alloys are preferred, the present invention also contemplates that the fusible link may be formed of copper, steel, or aluminum, although with such metals, a very fine filament must be used. While the wire 414 has been illustrated as being circular in cross section throughout its length, for certain applications it may be desirable to give the wire a different configuration, as by flattening the midportion thereof, as will be understood by those skilled in the art. In addition to flattening, the present invention contemplates that other operations, such as trimming, punching, stretching, etc., may be performed on the fusible link. Of course, if the wire is given a special configuration, this must be done prior to the molding operation.

Figure 27:
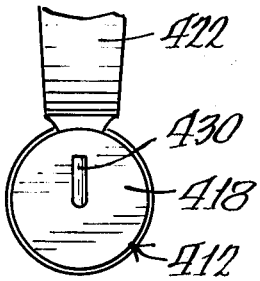
FIG. 27 is an end view of the left-hand end of the fuse taken generally along the plane 27—27 in FIG. 26.
Figure 28:
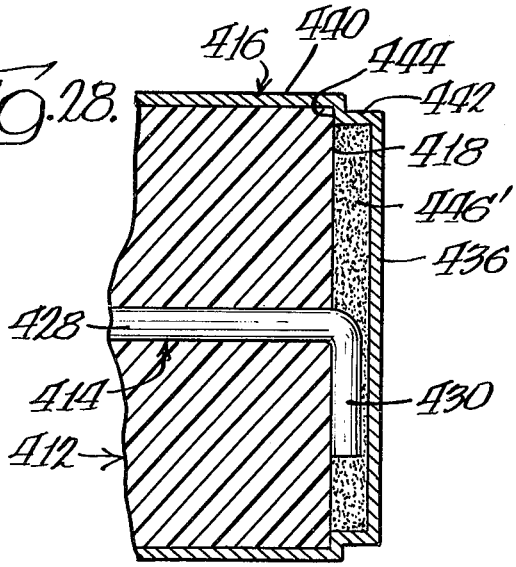
FIG. 28 is an enlarged, fragmentary, cross-sectional view of the right-hand end of the fuse taken generally along the plane 28—28 in FIG. 26.

Referring particularly to FIGS. 26, 27, and 28, it will be noted that the wire 414 has end portions 430 which are bent, angled, or otherwise shaped, to lie out of alignment with the major portion 428 of the fusible link 414. In the embodiment illustrated, the end portions 430 are bent at a substantially right angle to the major portions 428 of the fusible link 414 so that they lie parallel and adjacent to the end surface 418 of the fuse body 412. However, it is to be realized that other end portion configurations are possible, such as the coiled configuration disclosed in the U.S. Pat. No. 3,832,664 and illustrated in FIG. 3 of that patent.

The fuse of the present invention is typically manufactured by extending a single elongate fuse wire 414 between a plurality of cavities of a multi-cavity mold. A plastic material of the above-described type is then simultaneously injected into each of the cavities while the wire is simultaneously retained in centered relationship with respect to the cavities, to form the fuse bodies 412. Subsequent to the molding operation, the outwardly projecting end portions 430 of the wire 414, which were formerly positioned between the mold cavities, are severed to provide wire end portions 430. The end portions are then bent in the illustrated configuration to provide for improved electrical contact and thermal conduction between the fusible link 414 and the end caps 416 when the end caps 416 are subsequently placed on the fuse body ends.

Alternatively, the ends 430 of the fusible link 414 may be left extending generally outwardly from the fuse body 412 and substantially perpendicular to the fuse body end surface 418. Then the end caps 416 are assembled to the body 412 by axial relative movement therebetween. Each end cap 416 has an end wall 436 which, when an end cap 416 is moved onto the end of the fuse body 412, engages the end 430 of the fusible link 414 and causes it to bend over toward or against the fuse body end surface 418 in the orientation illustrated in FIGS. 26, 27, and 28. The end portion 430 need not lie directly flat against the end surface 418 but may be angled outwardly with respect thereto.

In order to accommodate high-speed manufacturing of the fuse of the present invention with end cap applying apparatus which may not always be properly adjusted, a novel end cap structure is provided to prevent severing of the end portion 430 of the fuse wire 414 and to provide a reservoir for an electrically conducting fluid material to improve electrical conductance between the end cap 416 and the element 414. Specifically, each end cap is a cup-shaped element that includes, in addition to the end wall 436, a sidewall comprising a first cylindrical portion 440 and a second cylindrical portion 442 having a diameter less than the first portion and joined to the first portion by an annular shoulder 444. The inside surface of the sidewall, and specifically the inside surface of the first cylindrical portion 440, is adapted to compressively engage or embrace the sidewall of the fuse body 412 adjacent the end to which the cap 416 is applied.

The cap 416 is inserted onto the end of the fuse body 412 until the annular shoulder 444 bears against the fuse body end surface 418 in direct contact therewith. In this manner, the annular shoulder 444 acts as an abutment means to prevent the end cap from being pushed onto the end of the fuse body 412 by more than a certain amount. This serves to maintain the end wall 436 at a predetermined distance from the fuse body end surface 418.

With certain types of small diameter fuse wires 414, and with certain types of end cap applying apparatus operated at high speeds, the tendency to push the end caps 416 against the end surface 418 of the fuse body 412 with sufficient force to sever the end portion 430 of the fuse wire 414 is thus accommodated. That is, if the length of the second cylindrical portion 442 is made equal to, or slightly greater than, the diameter of the end portion 430, the end portion 430 cannot be compressively engaged between the fuse body end surface 418 and the end cap end wall 436 with sufficient force to sever the end portion 430 from the major portion 428 of the fusible link wire 414. Thus, high speed end cap applying apparatus can be used even though they tend to force the end cap 416 onto the ends of the fuse body 412 with an undue amount of force. Thus, the need for maintaining such end cap applying apparatus in a carefully calibrated operating condition is substantially reduced or eliminated.

The second cylindrical portion 442 forms a reservoir or chamber for receiving an electrically conducting material such as an eutectic metal alloy 446 as illustrated in FIG. 26. The electrically conducting material 446 may be an electrically conducting solder or other suitable material, such as a solder paint or other conductive paint. Solder, comprising 66⅔ parts by weight of tin and 33⅓ parts by weight of lead is preferably used as the electrically conducting material 446. The electrically conducting material 446 is deposited as a solid, generally cylindrical charge of flux core solder (about 0.062 inch in diameter and 0.125 inch in length) or as a liquid drop into an end cap 416 when the end cap is in a vertical position with the end wall 436 at the bottom. When a solid charge of material 446 is used, the end cap 416 may be pre-heated or may be subsequently heated to cause the material to flow over the inner surfaces of the end cap. Preferably, a predetermined amount of solder 446 is deposited so that about 85% of the volume of the reservoir in the end cap 416 is filled. The solder 446 rapidly cools and solidifies with a generally concave surface as illustrated in the end cap 416 on the left hand end of the fuse body 412 in FIG. 26. The end cap 416 is subsequently placed on the fuse body and the end cap is heated to remelt the solder 446 around the wire-like fuse element end portions 430.

The electrically conducting material or solder 446 improves electrical conductance between the end caps 416 and the wire-like fuse element 414. Specifically, if the end wall 436 of the end cap is spaced outwardly of the bent over end portion 430 of the fusible link 414 so that it is not in contact therewith as illustrated in FIG. 28, the remelted electrically conducting material or remelted solder 446' serves to provide an electrically conducting path between the fuse link end portion 430 and the end cap 416. This is especially advantageous when using high speed end cap applying machines which may, owing to improper calibration or impact rebound, tend to pull the end cap 416 slightly away from the fuse body end 418 after initially placing the end cap 416 thereon.

Preferably, the solder is used with a flux in the form of a flux core solder. Typically, after the solder is deposited as a drop of liquid in the end cap 416 or as a solid charge of flux core solder in a preheated or subsequently heated end cap 416, much of the flux in the solder rises to the surface of the drop and forms a layer or coating of flux over the entire concave surface of the solder within the reservoir of the end cap 416. Both of the solder per se and the flux layer on top of the solder cool and solidify very rapidly and before any subsequent steps in the manufacturing process can be undertaken. After the end cap 416 has been properly placed upon the fuse body end, heat is applied to the end cap 416 to effect a remelting of the solder to cause the solder to flow between and around the end cap wall 436, the fuse body end surface 418, and the fuse link end portion 430.

With some types of solder, a higher temperature may be required to remelt the solder than was required to first melt the solder originally. This may be because of the creation of the flux coating on the surface of the solder deposit in the end cap or because of other changes within the solder brought about by the first application of heat. In any case, when the remelted solder 446' flows around the fusible link end portion 430, it is desirable that the temperature of the liquid solder be less than the temperature required to melt the fusible link end portion 430. Preferably, the remelting temperature of the solder should be between 80° and 100° F. less than the melting temperature of the fuse link end portion 430.

Owing to the fact that the end wall is displaced outwardly a predetermined distance from the fuse body end surface 418 by annular shoulder 444, heat that is applied to the end cap end wall 436 is conducted through the end wall and to the drop of solder with very little of the heat being conducted to the fuse body end surface 418 and fuse link end portion 430. Most of the heat is conducted through the end cap end wall 436 to the solder drop which acts as a heat sink. The temperature of the solder drop is then raised above its melting point so that it becomes liquid.

In practice, it has been found that with appropriate application of heat to brass end caps for a very short period of time, as by resistance heating, the surface coating of the flux on the solder deposit within the end cap 416 becomes liquid slightly sooner than, or at least at the same time as, the solder beneath it. In any case, the flux coating on the surface of the solder deposit is so quickly and sufficiently heated that it is violently agitated against the fuse link end portion 430 so that it effectively cleans and coats the fuse link end portion 430. By the time the fuse link end portion 430 has been cleaned and coated with the flux, the solder deposit has remelted and has also been sufficiently heated to become violently agitated so that it flows throughout all portions of the chamber defined by the end cap 416 and the fuse body end surface 418. The liquid solder then wets, and bonds to, all the surfaces cleaned by the flux—especially the fuse link end portion 430. Thus, any time consuming and expensive requirement for separately cleaning and fluxing the fuse link end portion 430 is eliminated. Since relatively little heat is transmitted directly to the fuse link end portion 430 and the fuse body end surface 418, the likelihood of the melting of the fuse link end portion 430 and the fuse body material is greatly reduced. After the solder has been melted and violently agitated to flow throughout the reservoir or chamber within the end cap 416, it cools and solidifies very quickly upon termination of the application of heat to the end cap 416. The result is that relatively little heat is transmitted to the fuse body during this process.

The wire-like fusible element 414 may be formed of material having a degree of inherent resiliency whereby the end portions 430, after being initially bent over, are urged outwardly against the end walls 436 of the caps 416. However, as previously stated, with the use of the electrically conducting material 446, this is not necessary because the fuse link end portions 430 need not be in direct contact with the end cap end walls 436.

With reference to FIG. 28, it is to be observed that the reduced diameter of the cylindrical portion 442 relative to the cylindrical portion 440 provides a chamber which is defined, on one side, by the fuse body end surface 418 and that the remelted electrically conducting material 446' is thus substantially prevented by the end surface 418 from being forced out of the chamber and between the first cylindrical portion 440 and the fuse body 412. Thus, undesirable loss of the material 446' is substantially reduced.

The inner diameter of the sidewall or first cylindrical portion 440 of end cap 416 is preferably about the same size of the outer diameter of the end portion of the fuse body 412, so as to be positively retained thereon. To facilitate assembly, the end caps 416 are preferably heated prior to placement on the fuse body, with the subsequent shrinkage of the end caps 416 upon cooling causing them to strongly grip the fuse body. The hot end caps 416 also tend to melt the portions of the plastic body in contact therewith, so that the end caps adhere to the ends of the fuse body.

The first cylindrical portion 440 of the end cap 416 is sized so as to comply with previously existing standards, such as those established by the Society of Automotive Engineers. As is well known, the end caps 416 may be formed of brass, or a brass alloy and may be plated to prevent oxidation. End caps 416 are assembled to the outer end portion of the fuse body 412 by shifting the end caps axially of the fuse body, and the end caps 416 are preferably simultaneously placed on the fuse body 412.

Though the embodiment illustrated in FIGS. 25 through 28 is that of a fuse, it is contemplated that the novel end cap structure of the present invention be used with other suitable electrically conducting components which are encapsulated by a material, e.g., resistors, capacitors, transistors, and the like. With such other electrically conducting components, the body material need not necessarily be a thermoplastic material but may be glass, ceramic, or other material as the case may be. Further, though the end caps are illustrated as having a cylindrical first portion and sidewall, other end cap shapes, as well as other component body shapes, may be used and the end cap sidewall may or may not compressively embrace the body.

From the foregoing, it will be observed that numerous variations and modifications may be effected without departing from the true spirit and scope of the novel concept of the invention. It is to be understood that no limitation with respect to the specific apparatus and methods illustrated and described herein is intended or should be inferred. It is, of course, intended to cover by the appended claims all such modifications as fall within the scope of the claims.

I claim:

1. An encapsulated plug-in fuse comprising:

a pair of spaced-apart, generally parallel blades, each blade having at one of its ends a terminal portion for being connected into an electrical circuit;

an elongate fusible link having two ends and comprising a material having a melting point temperature substantially lower than said blades, said fusible link disposed substantially perpendicular to said blades and connected at each of its ends to one of said blades; and a solid unitary body of electrically insulating material encapsulating said fusible link and the end of each said blade connected to said fusible link, the external surfaces of said link and portions of said blades being in intimate contact with said material and said terminal portions of said blades projecting from said material.

2. An encapsulated plug-in fuse comprising:

an elongate fusible link having two ends;

a pair of spaced-apart, generally parallel blades disposed substantially perpendicular to said fusible link; each blade connected at one of its ends to an end of said fusible link; each blade further having at the other of its ends a terminal portion for being connected into an electrical circuit; and a solid unitary body of electrically insulating material encapsulating said fusible link and the end of each said blade connected to said fusible link, said unitary body having a generally one half disc-like shape and having a region of increased thickness adjacent said fusible link, the external surfaces of said link and portions of said blades being in intimate contact with said material and said terminal portions of said blades projecting from said material.

3. An encapsulated plug-in fuse in accordance with claim 2 in which said body further has regions of increased thickness adjacent said blades to provide a substantially symmetrical temperature gradient and consequent uniform heat transmission from fusible link through said body.

4. The encapsulated plug-in fuse in accordance with claim 3 in which said regions of increased thickness are defined on the two major side surfaces of said one half disc-like body by protuberances in superposed alignment with said fusible link and said blades, each said protuberance having the general shape of a cylindrical sector presenting a generally convex, circular arc, exterior surface.

5. An encapsulated plug-in fuse comprising:

an elongate fusible link having two ends;

a pair of spaced-apart, generally parallel blades disposed substantially perpendicular to said fusible link; each blade connected at one of its ends to an end of said fusible link, each blade further having at the other of its ends a terminal portion for being connected into an electrical circuit; and a solid unitary body of electrically insulating material encapsulating said fusible link and the end of each said blade connected to said fusible link, the external surfaces of said link and portions of said blades being in intimate contact with said material and said terminal portions of said blades projecting from said material, said encapsulating material being a substantially transparent thermoplastic material of relatively low thermal conductivity whereby said link melts without effecting substantial heat-induced degradation of said unitary body.

6. An encapsulated plug-in fuse in accordance with claim 1 in which both of said blades are substantially rectangular and coplanar.

7. An encapsulated plug-in fuse in accordance with claim 1 in which said fusible link comprises a substantially solid cylindrical wire.

8. An encapsulated plug-in fuse comprising:

a pair of spaced-apart, generally parallel metal terminal posts; an elongate fusible link disposed substantially perpendicular to, and connected with, each post; each post having at one end a cylindrical terminal for being received in a mating female spring connector; and a solid unitary body of electrically insulating transparent thermoplastic material encapsulating said link and a portion of each of said posts inwardly of said cylindrical terminal, the external surfaces of said link and said portions of said posts being in intimate contact with said material.

9. The fuse in accordance with claim 8 in which said fusible link is constituted from one of the following alloys: (a) 95 percent tin and 5 percent lead, (b) 96 percent tin and 4 percent silver, (c) tin and antimony.

10. The fuse in accordance with with claim 8 in which said terminal posts are one of brass, copper and spring aluminum.

11. The fuse in accordance with claim 8 in which said thermoplastic material is one of SAN, LEXAN, and high temperature nylon.

12. An encapsulated plug-in fuse in accordance with claim 8 in which said unitary body has a generally one half disc-like shape and in which said body has a region of increased thickness adjacent said fusible link to provide a substantially symmetrical temperature gradient and consequent uniform heat transmission from fusible link through said body.

13. The encapsulated plug-in fuse in accordance with claim 12 in which said region of increased thickness is defined on the two major side surfaces of said one half disc-like body by protuberances in superposed alignment with said fusible link, each said protuberance having the general shape of a cylindrical sector presenting a generally convex, circular arc, exterior surface.

14. The fuse in accordance with claim 8 in which said body encapsulates each of said posts for at least half of the length of each post.

15. The encapsulated fuse in accordance with claim 8 wherein each said cylindrical terminal is filled with said electrically insulating material.

16. The method of making an encapsulated plug-in fuse comprising the steps of:

providing a pair of posts, each post having at one end a terminal portion for being connected into an electrical circuit; and arranging said posts in spaced-apart, generally parallel relationship;

providing a relatively small diameter cylindrical fuse wire comprising a material having a melting point temperature substantially lower than said posts and placing the fuse wire perpendicular to and across said posts;

connecting said wire to each of said posts; and encapsulating said fuse wire and the end of each post that is connected to said fuse wire with a solid unitary body of substantially transparent thermoplastic electrically insulating material so that the external surfaces of said wire and the ends of each post connected to said wire are in intimate contact with said material.

17. The method of claim 16 in which said step of connecting said wire to each of said posts includes soldering said wire to said posts.

18. The method of making an encapsulated plug-in fuse comprising the steps of:

providing a pair of metal blades and a substantially cylindrical fuse wire having a relatively small diameter comprising a material having a melting point temperature substantially lower than said blades, each blade having at one end a terminal portion for being connected into an electrical circuit;

arranging said blades in space-apart, generally parallel relationship;

aligning said fuse wire substantially perpendicular to said blades;

soldering said wire on each end to one of said blades to provide an electrically conductive path from one of said blades through the fuse wire to the terminal portion of the other of said blades; and encapsulating said fuse wire and a portion of each of said blades with a solid unitary body of electrically insulating transparent thermoplastic material so that the external surfaces of said wire and the end of each blade soldered to said fuse wire are in intimate contact with said material.

19. The method of claim 18 wherein the step of encapsulating includes encapsulating each of said blades for at least half of the length of each blade.

20. An encapsulated plug-in fuse comprising:

a pair of spaced-apart, generally parallel metal terminal posts;

an elongate fusible link disposed substantially perpendicular to, and connected with, each post;

two cylindrical terminal means for being received in mating spring connectors, each said terminal means connected at one end to one of said posts, each said terminal means comprising at least one first wall member having a generally hemicylindrical surface and at least a second adjacent wall member having an oppositely oriented, generally hemicylindrical surface, said wall members each having a first end and a second end with said first and second ends located substantially 180 degrees apart;

a first connecting strip secured to said first end of each wall member;

a second connecting strip secured to said second end of each wall member; and a solid unitary body of electrically insulating material encapsulating said link and a portion of each of said posts inwardly of said cylindrical terminal means, the external surfaces of said link and said portions of said posts being in intimate contact with said material.

21. The fuse in accordance with claim 20 in which said first and second conducting strips are generally planar rectangular members and are integrally connected with said wall members.

22. The fuse in accordance with claim 21 in which said conducting strips are oriented in parallel planes and are each generally tangent to the hemicylindrical surfaces of said wall members.

23. The fuse in accordance with claim 20 in which said adjacent wall members form said cylindrical terminal means extending outwardly from said posts about an axis generally parallel with said fusible link.

24. The method of making an encapsulated plug-in fuse comprising the steps of:

providing a strip of metal;

forming a plurality of generally parallel slits in said strip of metal, said slits defining wall members therebetween and defining an unslit region at each end of said slits;

stamping from said strip a pair of generally L-shaped metal plates having a post portion and a terminal portion perpendicular to said post portion, said plates arranged in oppositely oriented, spaced-apart relation with said posts generally parallel and with said terminal portion containing said slits;

forming each said terminal portion into a generally cylindrical shape and orienting the exterior surfaces of adjacent wall members into oppositely facing, generally hemicylindrical surfaces;

placing a fusible link perpendicular to and across said posts and connecting said link to each of said posts; and encapsulating said fusible link and at least a portion of each post at the connection to said fusible link with a solid unitary body of electrically insulating material so that the external surfaces of said link and of said portion of each post connected to said link are in intimate contact with said material.

25. The method of claim 24 in which said step of forming each said terminal portion into a generally cylindrical shape includes generally simultaneously (1) moving said unslit regions at each end of said slits closer together, (2) bending said wall members outwardly to orient the exterior surfaces into generally hemi-cylindrical surfaces, and (3) forming an S-shaped configuration in said post portion adjacent said terminal portion.

* * * * *